United States Patent [19]

Kazda

[11] Patent Number: 4,750,507

[45] Date of Patent: Jun. 14, 1988

[54] ORTHOPEDIC CRUTCH MAKING IT POSSIBLE TO PLACE ONLY A CONTROLLED AND ADJUSTABLE PART OF THE BODY WEIGHT ON THE INJURED LOWER LIMB DURING WALKING

[76] Inventor: Jiri G. Kazda, Via Cantonale 46b, 6963 Pregassona, Switzerland

[21] Appl. No.: 31,672

[22] Filed: Mar. 31, 1987

[30] Foreign Application Priority Data

Apr. 18, 1986 [CH] Switzerland ..... 1562/86

[51] Int. Cl.[4] ..... A61H 3/02

[52] U.S. Cl. ..... 135/68

[58] Field of Search ..... 128/80 R, 80 B, 80 DB, 128/80 E; 91/169, 170 R; 417/545; 135/69, 71, 72, 73, 65, 66, 67, 68

[56] References Cited

U.S. PATENT DOCUMENTS

| | | | |
|---|---|---|---|
| 2,696,826 | 12/1954 | Davis | 135/73 |
| 3,335,735 | 8/1967 | Colegrove et al. | 135/69 |
| 4,252,137 | 2/1981 | Cohen | 135/75 |

*Primary Examiner*—Robert A. Hafer
*Assistant Examiner*—Charles H. Sam
*Attorney, Agent, or Firm*—Young & Thompson

[57] ABSTRACT

The crutch comprises adjustable elements (1, 7, 10, 12) applied to each of the two crutches and operated, during walking, by the corresponding hand. The adjustable elements applied to each crutch comprise a lever (1) pressed by hand (14) and fulcrumed (2) on a support (3) fastened along sleeve (4) of the crutch; a rod (5) controlling piston (6) of hydraulic damper (7), whose fluid (8) is made to pass through an opening of adjustable size to vary the pressure, being connected to the rod.

2 Claims, 1 Drawing Sheet

Figures 1, 2, 3:
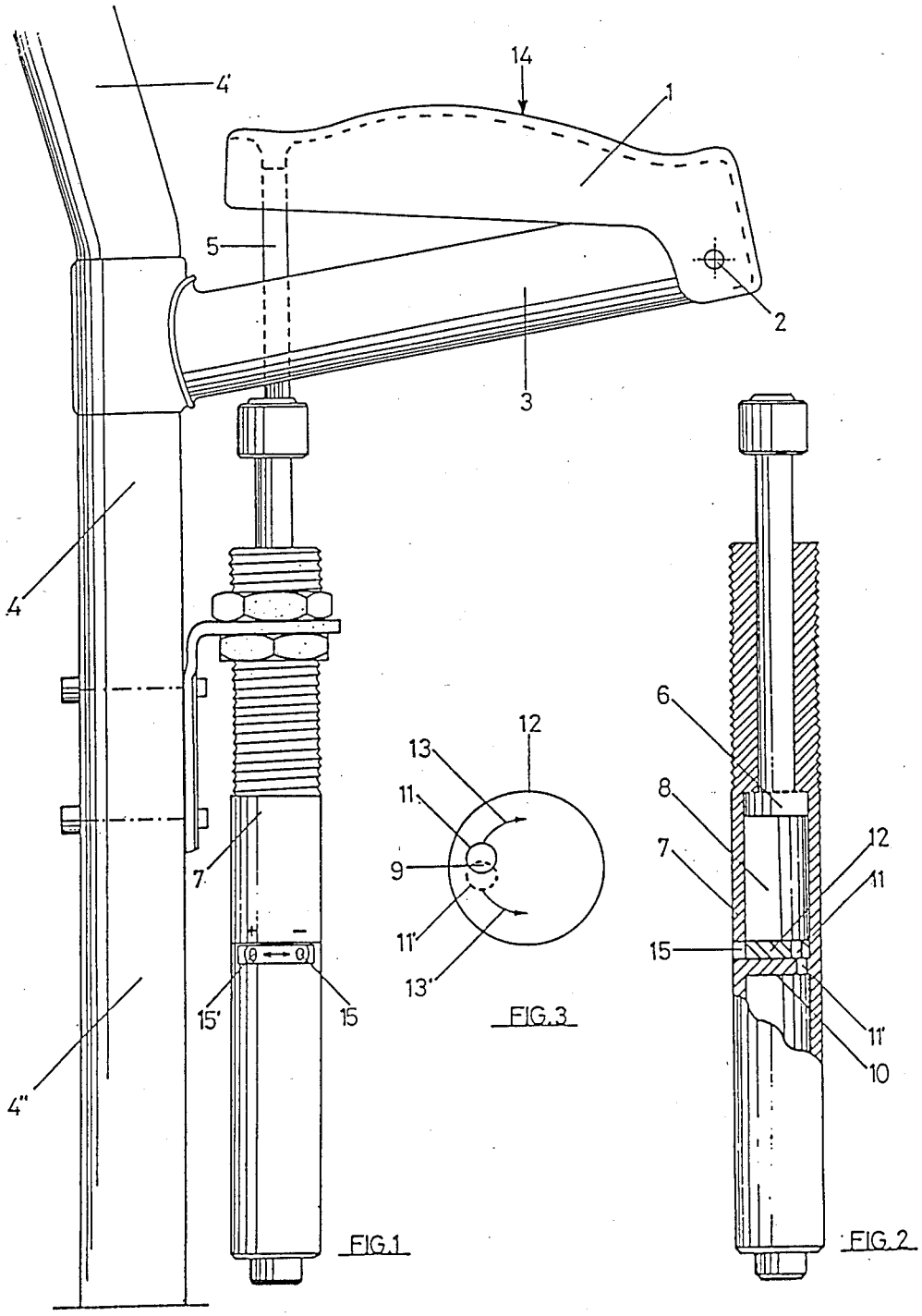

14
1
4'
5
2
3
4
7
15'
15
4"

12
13
11
9
11'
13'

6
8
7
12
11
15
11'
10

ORTHOPEDIC CRUTCH MAKING IT POSSIBLE TO PLACE ONLY A CONTROLLED AND ADJUSTABLE PART OF THE BODY WEIGHT ON THE INJURED LOWER LIMB DURING WALKING

This invention has as its object an orthopedic crutch making it possible to place only a controlled and adjustable part of the body weight on the injured lower limb during walking.

In the case of traumatological or orthopedic medicine for bone traumas of the lower extremities there are rehabilitative therapeutic measures that aim at strengthening, facilitating or accelerating the bone consolidation (callus) of the fractures.

It is known that the active process of this bone consolidation is considerably stimulated by suitable pressure of one bone fragment against another.

In practice, the patient is ordered to walk with the use of crutches, placing on the injured leg only a limited weight—varying from 20 to 40 kg (according to the prescription of the physician). But the patient cannot establish and be sure of how many kilograms have been taken off the limb in question; testing on the scales used still gives the patient a psychic impression of taking weight off by means of the hand, which is only very approximate. Over time, with development of the muscular strength of the hand and an increase of the irritability threshold of the barorecptors, the psychic impressions change regarding the estimate of the weight on the hand with taking weight off the injured limb change.

According to the information of the inventor, a system does not yet exist which makes possible an exact control of the weight load on the lower limb in question.

The aims of the invention therefore are:

(1) to enable the patient at every step to control the weight load on the leg:

(2) to preestablish this weight by calibration (in kg), according to the physician's prescription.

These aims are achieved with the crutch according to the invention, characterized by adjustable elements applied to each of the two crutches and operated, during walking, by the corresponding hand.

According to a preferred embodiment of the crutch, said adjustable elements applied to each crutch comprise a lever pressed by hand and fulcrumed on a support fastened along the sleeve; a rod controlling a small piston of a hydraulic damper, whose fluid is made to pass through an opening of adjustable size to vary the pressure being connected to said lever.

For greater clarity the accompanying drawing shows said preferred nonlimiting and nonbinding embodiment.

FIG. 1 shows the front view of the adjustable elements applied to the crutch, operated by hand during walking.

FIG. 2 partially represents the axial section of the damper forming part of said elements.

FIG. 3 represents a detail.

The crutch, shown only partially in FIG. 1, exhibits an intermediate tubular part or sleeve 4, an upper part 4' ending at the top in a support (not shown) for the armpit and a lower part 4'' ending in a tip (also not shown).

Elements 3, 7 are fastened to intermediate part 4, while lever 1 is operated by the patient's hand during walking.

The elements shown in FIGS. 2 and 3 allow the adjustment of force 14 to be exerted by hand on lever 1 to vary the body weight taken off during walking.

Said elements comprise a hydraulic cylinder 7, whose piston 6 (FIG. 2) compresses liquid 8, making it pass through opening 9 (FIG. 3) delimited by two holes 11 and 11' (FIG. 2 and 3) made respectively in rotating disk 12 and in diaphragm 10 of cylinder 7.

Rotation of disk 12 takes place by introducing a pin (a screwdriver) in hole 15 of disk 12 (FIG. 1 and 2) and angularly moving the hole into position 11' or into an intermediate position.

Of course, the devices that make it possible to vary force 14 on lever 1 can also be different provided they stay within the scope of protection of the invention.

The operation of the unit therefore is as follows: to be able to lower lever 1, the patient must transmit to it a determined and preestablished weight of his body, in a preestablished direction taking the load off his injured leg.

A patient (for example) weighing 80 kg should place a weight of 20 kg on a limb. He must then by his hands—by resting on the crutches—take off of his body weight 60 kg, or 30 kg per crutch. The elastic resistance of each damper is preestablished for a weight of 30 kg and a period of pressure corresponding to stepping on the injured leg. The patient begins his step with crutches having levers in the elevated position and finishes with them in the horizontal position. During the regular lowering of the piston of the damper with the preestablished resistance, the desired weight on the injured leg always remains the same.

I claim:

1. An orthopedic crutch making is possible to place only a controlled and adjustable part of the body weight on an injured lower limb during walking, comprising am inextensible upright crutch having a laterally projecting hand support, and a handle pivotally mounted on said hand support for vertical swinging movement about a horizontal axis, a hydraulic damper carried by the crutch and receiving a piston attached to the handle, the damper having an opening therein of adjustable size and the piston forcing hydraulic fluid through said opening upon downward pressure on the handle by the hand of the user of the crutch, whereby the pressure that the user can apply on the handle, and hence the pressure that is relieved from the lower limb of the user during walking, can be adjusted by adjusting the size of said opening.

2. A crutch as claimed in claim 1, in which said handle is inclined upwardly from said axis when said piston is fully raised and inclined downwardly from said axis when said piston is completely lowered.

* * * * *